United States Patent [19]

Lovat

[11] 3,961,825

[45] June 8, 1976

[54] TUNNELLING MACHINE

[76] Inventor: Richard Lovat, 42 Grovtree Ave., Rexdale, Ontario, Canada

[22] Filed: Aug. 5, 1974

[21] Appl. No.: 494,609

[52] U.S. Cl. ..... 299/33; 61/85; 299/31

[51] Int. Cl.[2] ..... E21D 9/04

[58] Field of Search ..... 299/10, 31, 33; 61/84, 61/85; 49/41

[56] References Cited

UNITED STATES PATENTS

| | | | |
|---|---|---|---|
| 1,503,485 | 8/1924 | Conley | 49/41 X |
| 3,355,215 | 11/1967 | Haspert et al. | 299/31 X |
| 3,378,305 | 4/1968 | Geldmacher | 299/33 |
| 3,382,002 | 5/1968 | Tabor | 299/31 X |
| 3,511,539 | 5/1970 | Schonfeld | 299/31 X |
| 3,561,223 | 2/1971 | Tabor | 299/33 X |
| 3,613,383 | 10/1971 | Fiske | 299/31 X |
| 3,672,726 | 6/1972 | House | 299/31 |
| 3,856,357 | 12/1974 | Wharton | 299/12 X |

FOREIGN PATENTS OR APPLICATIONS

| | | | |
|---|---|---|---|
| 36,880 | 7/1956 | Poland | 299/33 |

*Primary Examiner*—Ernest R. Purser
*Assistant Examiner*—William F. Pate, III

[57] ABSTRACT

An apparatus for tunnelling through soil, of the type in which a conical cutting head is rotatably mounted coaxially on a cylindrical housing and a toothed cutter bar is mounted radially on the cutting head adjacent an aperture in the cutting head. A flood door is mounted on the cutting head and is movable to open or close the aperture. Preferably a pair of doors are individually operable to converge or diverge in varying the size of the aperture. The cutter bar may be movable radially outward beyond the circumference of the cutting head to describe an arcuate path eccentric to the face of the cutting head.

14 Claims, 11 Drawing Figures

FIG. 1

TUNNELLING MACHINE

This invention relates to an apparatus for tunnelling through earth.

Earth tunnelling machines presently in use employ a toothed conical cutting head rotatably mounted on the end of a cylindrical housing. As the cutting head rotates and advances, the teeth on the head loosen the soil which passes through apertures in the head into the housing where it is collected and conveyed rearwardly. A problem is created when the tunnelling machine moves through soft or loose soil because the soil tends to flood the housing behind the cutting head making it difficult to rotate the head. Also, soil expands when exposed to air and it is necessary to board up the apertures in the cutting head when the tunnelling machine is left idle for any length of time, for example overnight.

It is an object of the present invention to provide an apparatus, for tunnelling through earth, which will control the ingress of soil into the housing of the apparatus.

Another problem in the use of such tunnelling machines is the difficulty in moving the apparatus in a curving path as it advances, to form bends in the tunnel.

A further object of the invention is to provide an apparatus for tunnelling through earth which will facilitate the advance of the machine in a curving path if desired.

Example embodiments of the invention are shown in the accompanying drawings in which.

Figure 1:
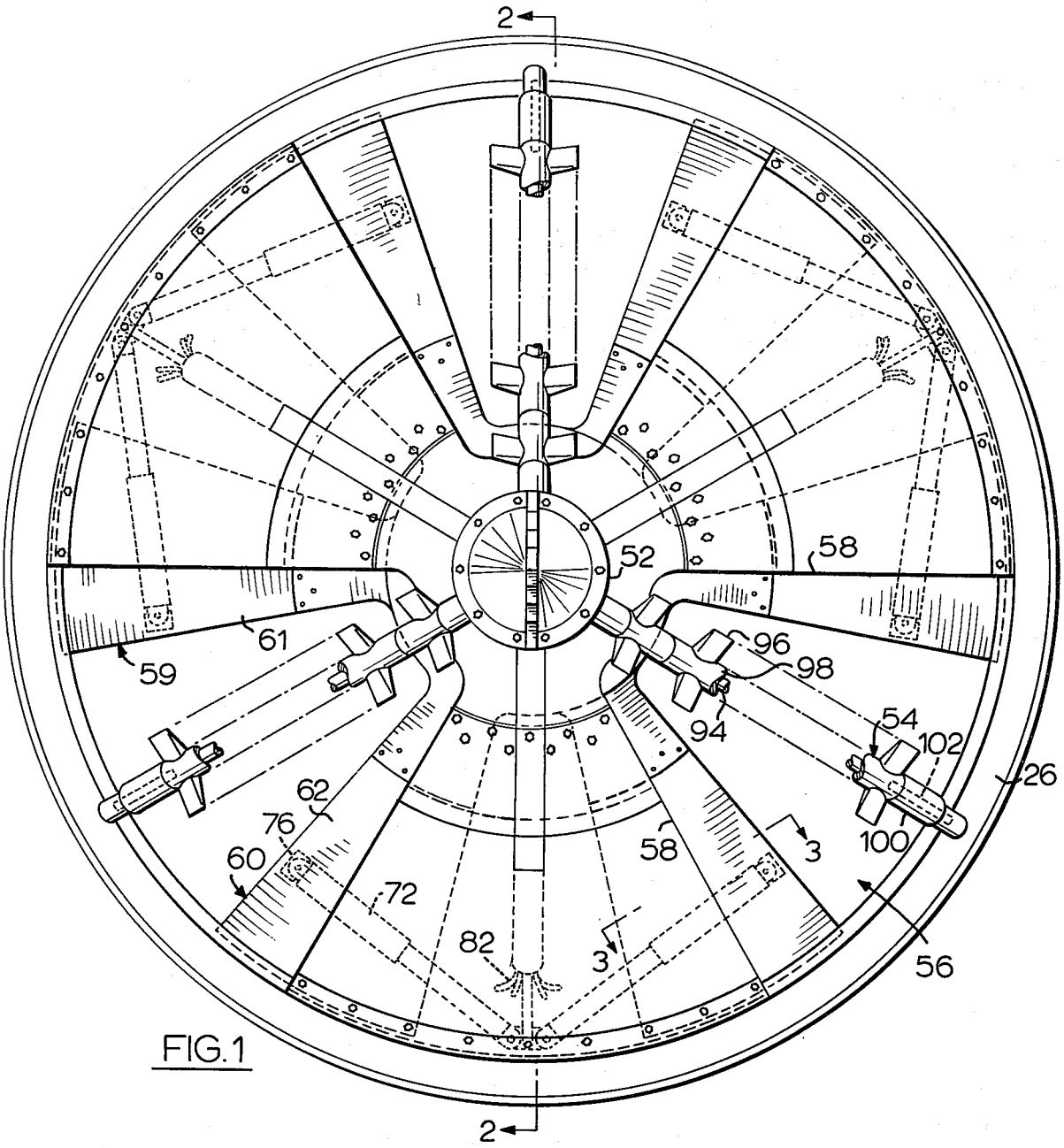
FIG. 1 is a front view in elevation of a cutting head of a tunnelling machine, with movable flood gates.
Figure 3:
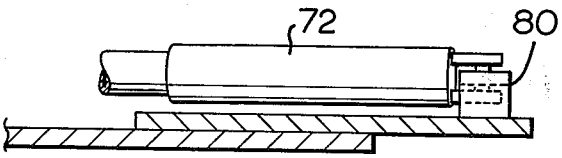
FIG. 3 is a side view of an hydraulic cylinder moving the flood gates, taken along line 3—3 of FIG. 1.
Figure 4:
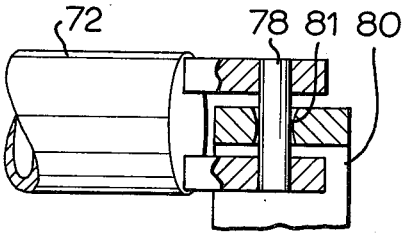
FIG. 4 is a side view, partly in cross-section, of the cylinder mount shown in FIG. 3.
Figure 2:
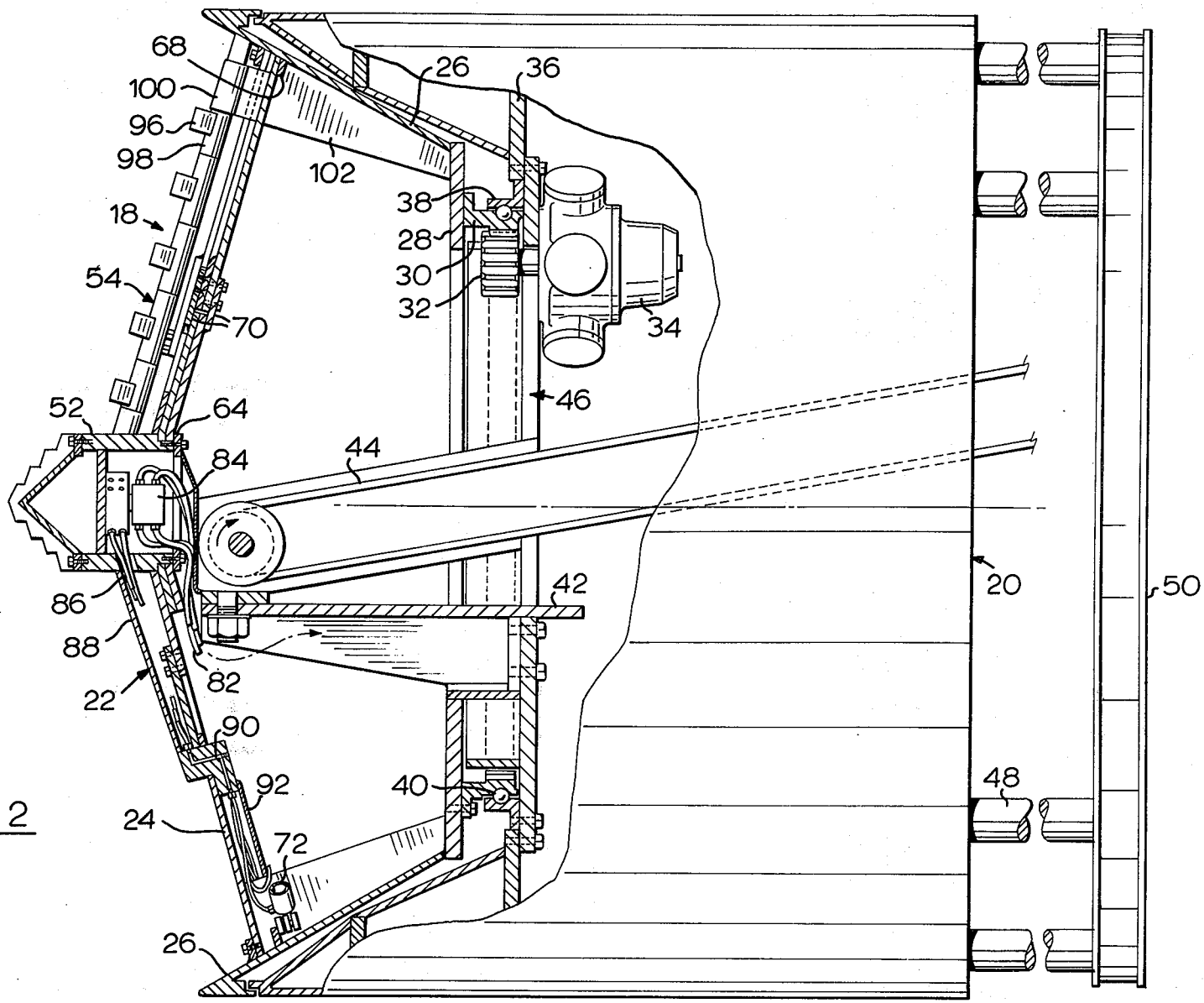
FIG. 2 is a cross-sectional side view taken along line 2—2 of FIG. 1, showing the cutting head rotatably mounted on a cylindrical housing.
Figure 6:
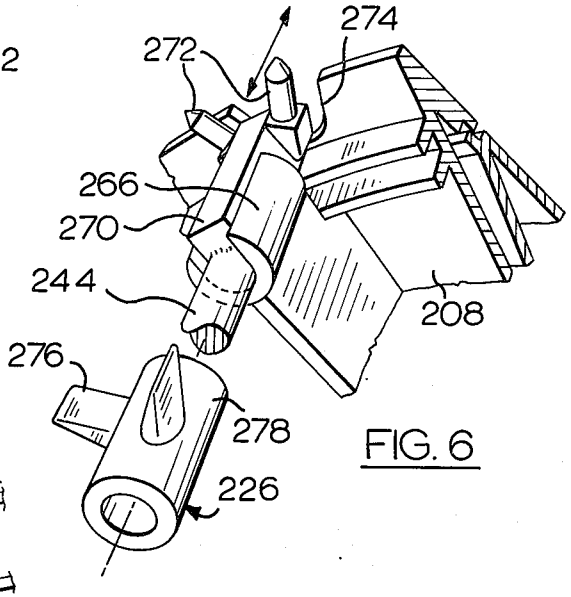
FIG. 6 is a perspective view of the outer end portion of the cutter bar of FIG. 5.
Figure 5:
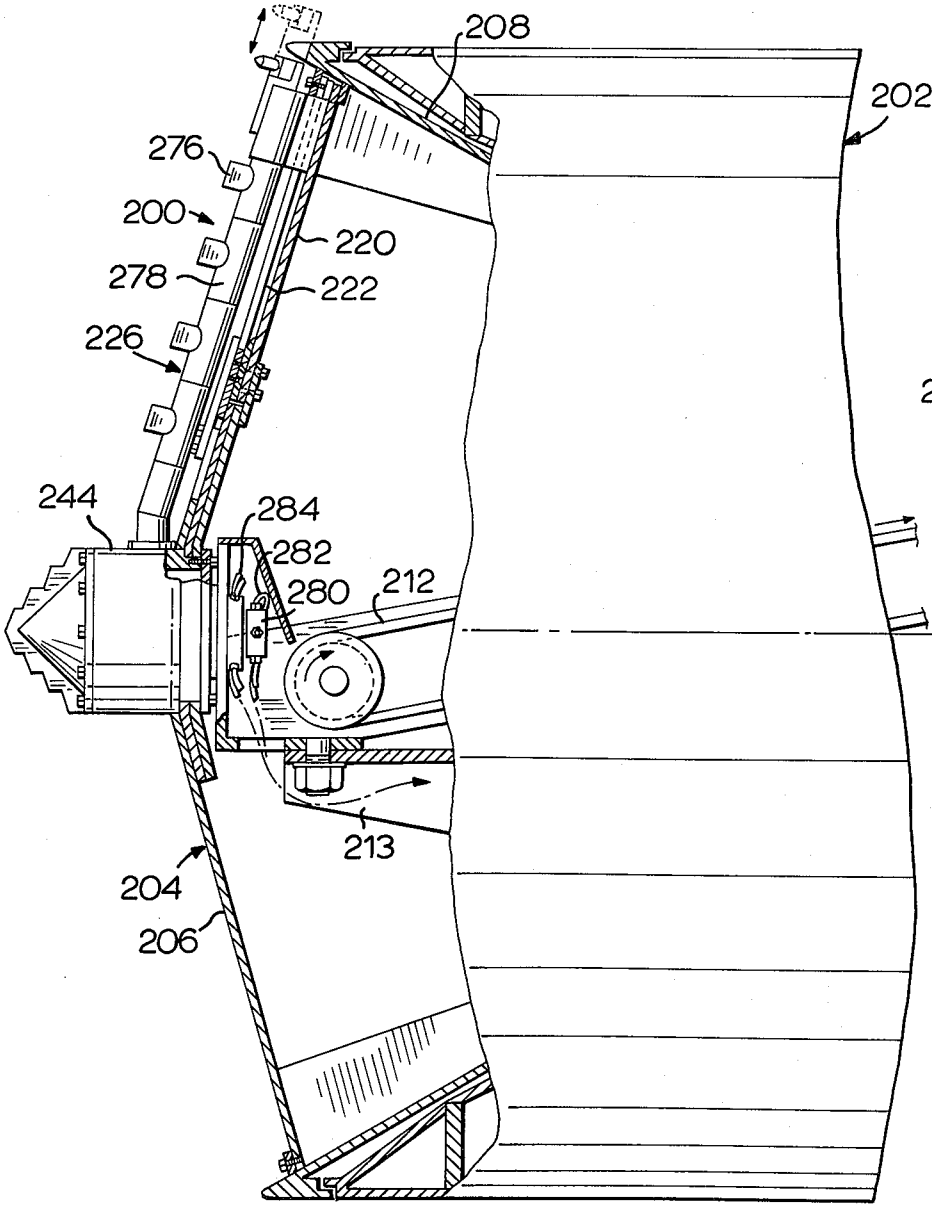
FIG. 5 is a view similar to FIG. 2, showing a cutting head having an eccentrically operable toothed cutter bar.

The example embodiment shown in FIGS. 1 to 4 of the drawings consists of a tunnelling device 18 having a cylindrical housing 20 on which a coaxial conical cutting head 22 is rotatably mounted. In the drawings housing 20, which is of known construction, has been indicated diagramatically. Cutting head 22 comprises a conical face plate 24, an inversely conical, a truncated side wall 26, and a base plate 28 all fixed together. Base plate 28 carries an internally toothed gear ring 30 engaged by a plurality of gears 32 each driven by an hydraulic motor 34 which is mounted on a plate 36 fixed to the inner surface of housing 20. Plate 36 also carries a bearing ring 38 which cooperates with gear ring 30 to form a cage for ball bearings 40 on which cutting head 22 rotates.

A cantilever platform 42, fixed on plate 36 and projecting towards face plate 24 of cutting head 22, supports the forward end of an endless conveyor 44 which is centrally located in the cutting head and extends rearwardly through an opening 46 in plate 36 and in housing 22 in known manner.

Housing 22 is advanced forwardly, also in known manner, by the operation of a plurality of hydraulic jacks, not shown, which are mounted on the inner surface of the housing. A piston rod 48 of each hydraulic jack acts against an adjustable pushing ring 50 which bears against ribbing placed against the wall of the tunnel immediately behind housing 22. When housing 22 has advanced the full stroke of the hydraulic jacks, piston rods 48 are retracted and further ribbing is placed against the tunnel wall.

Face plate 24 extends from a hub 52 to side wall 26 of cutting head 22 and, forwardly of the face plate, three cutter bars 54 also extend from the hub to the side wall at 120° intervals about the hub. Face plate 24 is cut away behind each cutter bar 54 to provide an aperture 56 having side edges 58 located radially with respect to hub 52. Positioned contiguously behind face plate 24 are two fan plates 59 and 60 each having three lobes or blades extending radially outward from hub 52 to provide doors 61 and 62 respectively for apertures 56. Doors 61 and 62 are rotatably slidable at one end in a common slot 64 circumscribing hub 52 and at the other end in a common slot 66 formed by face plate 24 and a flange 68 fixed on the side wall 26 of cutting head 22. Each door 61 and 62 is sectioned and the sections are removably fixed together by flange plates 70.

A separate hydraulic jack lies behind each door 61 and 62. Each jack 72 is pivotally attached at one end by a pin 74 to a bracket 76 fixed to door 61 or 62 and at the other end by a pin 78 to a bracket 80 fixed to side wall 26. Pin 78 passes through an aperture 81 in bracket 80, the aperture being flared outwardly at both ends to allow the pin to rock laterally about its centre point. Jacks 72 are located to move doors 61 and 62 of each aperture 56 towards and away from each other to close or open the aperture. Since doors 61 are lobes of fan plate 59 they move in unison and similarly doors 62 also move in unison. The hydraulic actuation of jacks 72 is provided from a controlled pressure source (not shown) through conduits 82 which connect with a slip ring 84. Further conduits 86 connect slip ring 84 with jacks 72, passing behind a first shroud 88 in front of face plate 24, a passage 90 in the face plate, and a second shroud 92 behind the face plate.

Each cutter bar 54 comprises a shaft 94 fixed at one end to hub 52 and at the other end to side plate 26. Outwardly diverging cutter teeth 96 are fixed on a plurality of collars 98 which are keyed onto shaft 94. A boss 100 carried by shaft 94 is integral with a radial paddle 102 fixed to side wall 26 and extending back to meet base plate 28.

In the operation of the apparatus shown in FIGS. 1 to 4, cutting head 22 is rotated either clockwise or counter-clockwise on bearings 40 by motors 34. As cutting head 22 rotates, teeth 96 of cutter bars 54 bite into the soil ahead of the cutting head and the soil loosened by the cutter bars passes through apertures 56 to lodge on radial paddles 102 where it is carried upwards until the paddles reach a point above conveyor 44 whereupon the soil drops by gravity onto the conveyor and is carried rearwardly to a collection point. As cutting head 22 rotates, or when it is in a position of rest, doors 61 and 62 are actuable by jacks 72 to vary each aperture 56 behind each cutter bar 54. Since doors 61 and 62 are actuable by separate jacks 72, apertures 56 may be partially or completely blocked on either side of cutter bars 54 (when viewed as in FIG. 1). Partial closure of apertures 56 may be advantageous to control the entry of loose or soft soil through cutting head 22 into housing 20 and onto conveyor 44, otherwise the housing might be flooded. Usually only that portion of each aperture 56 located ahead of cutter bar 54 in the direction of rotation of cutting head 22 is opened and this allows the cutting head to be rotated in either direction (clockwise or counter-clockwise). Full closure of apertures 56 is made when loose or soft soil is being penetrated and the rotation of cutting head 22 has been stopped to advance and relocate pushing ring 50 after piston rods 48 have been fully extended. Also in loose or soft soil it is desirable to close aperture 56 when the apparatus is idle for a period of time, for example overnight, because when exposed to air the soil may increase in volume and flood housing 20.

During the opening or closing of doors 61 or 62, jack 72 is disposed across face plate 24 as a chord of varying length and pin 78 must be allowed to rock in aperture 81 to accommodate such a variation.

The example embodiment shown in FIGS. 5 to 11 of the drawings consists of a tunnelling device 200, as in the previous embodiment, with a cylindrical housing 202 and a co-axial conical cutting head 204. Cutting head 204 has a conical face plate 206, an inversely conical truncated side wall 208, and a base plate (not shown), all fixed together as in the previous embodiment. Cutting head 204 is journally mounted and driven as before. Also, an endless conveyor 212 is located in housing 202, mounted on a cantilever platform 213, as before.

Figure 11:
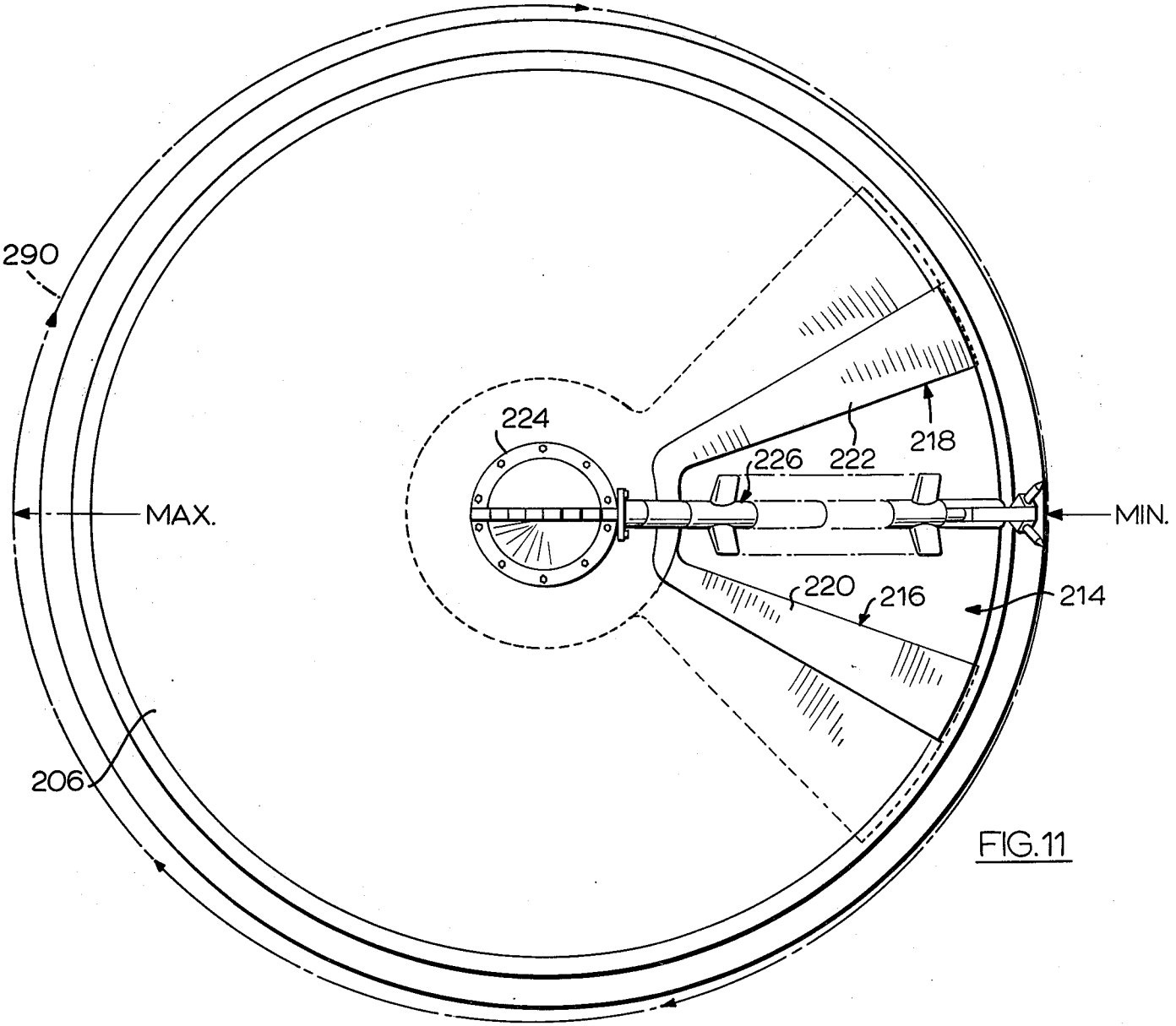
FIG. 11 is a front view in elevation of the cutting head of FIG. 5 showing the outer peripheral path of travel of the eccentric cutter bar.

As seen in FIG. 11, face plate 206 has only one aperture 214. A pair of fan plates 216 and 218 each carry a single lobe or blade to provide a pair of doors 220 and 222 respectively which are actuable by hydraulic jacks (not shown) to converge and close the aperture or to diverge and open the aperture, as before (hydraulic jacks similar in construction and operation to jacks 72 of the previous embodiment have been omitted from FIGS. 5 and 11 for clarity).

Figure 7:
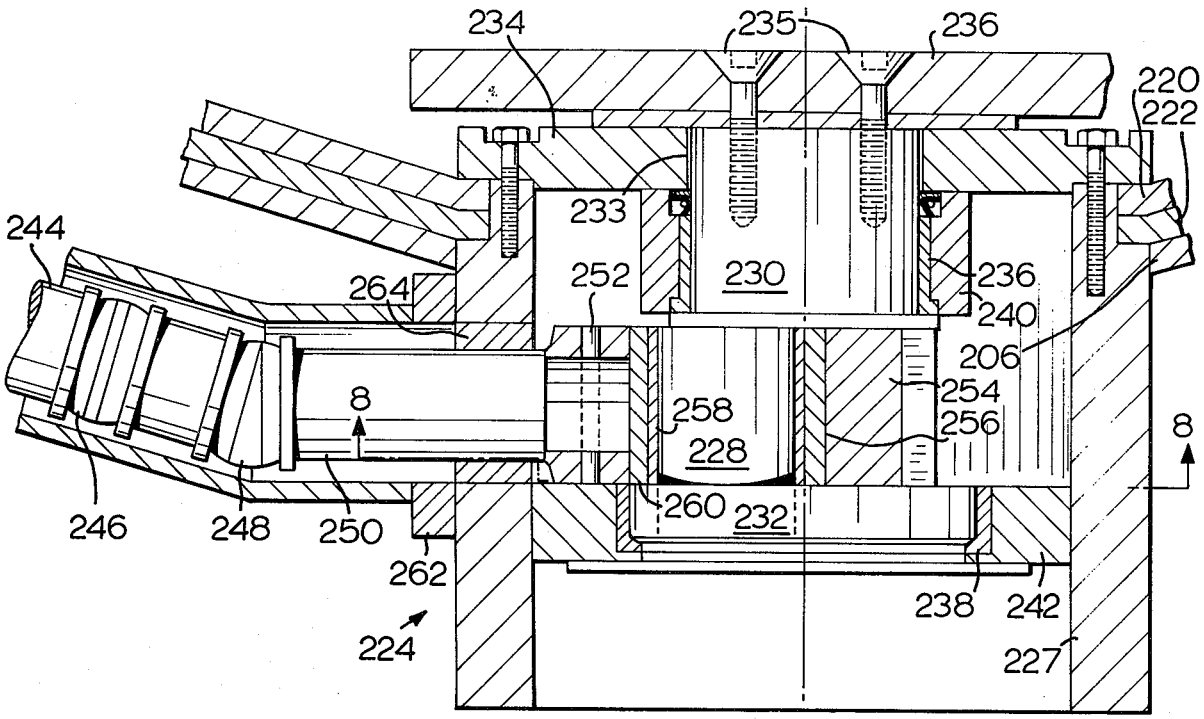
FIG. 7 is a cross-sectional view of the hub portion of the eccentric cutter bar of FIG. 5.

Face plate 206 extends from a hub 224 to side wall 208. Forwardly of face plate 206 is a single cutter bar 226 centrally located in front of aperture 214. As seen in FIG. 7, hub 224 consists of a cylindrical shell 227 housing an eccentric shaft 228 offset from the axis of the shell and fixed between two trunnions 230 and 232. Trunnion 230 projects through an aperture 233 in one end 234 of shell 226 and is fixed by bolts 235 to a bracket 236 which is in turn fixed to frame 213 of conveyor 212. Trunnions 230 and 232 are mounted in bearing sleeves 236 and 238 which are slidable in collars 240 and 242 fixed within shell 226 of hub 234 whereby the hub may rotate about the fixed trunnions and about eccentric shaft 228.

Cutter bar 226 consists of a shaft 244 connected at its inner end by a pair of universal joints 246 and 248 to one end of a stub shaft 250 which is fixed at its other end by a pin 252 to a guide 254. Eccentric shaft 228 carries a bushing 256 and a bearing sleeve 258 which engages a slot 260 in guide 254, and the guide slides along a pair of opposed channels 261 fixed on the inside surface of shell 226. Shaft 244 projects into shell 226 of hub 224 through a boss 262 fastened to the shell by bolts 263 and through a slip seal 264 in the shell.

The outer end of shaft 244 is slidable longitudinally in a boss 266 which is fixed on a paddle 268 secured on side wall 208 of cutting head 204. A spline 270 fixed axially on the outer end portion of shaft 244 carries a pair of radially projecting cutter prongs 272. A notch 274 in the edge of side wall 208 allows spline 270 to move longitudinally outward from the periphery of cutting head 204. As before, outwardly diverging cutter teeth 276 are fixed on a plurality of collars 278 which are keyed onto shaft 244. Although collars 278 are shown keyed directly onto shaft 244, in FIG. 5, to give the structure more strength it is preferable to have boss 266 extend the length of shaft 244 as a concentric tube with collars 278 keyed concentrically onto the tube.

A slip ring 280 (shown schematically in FIG. 5) mounted on support bracket 234 enables hydraulic conduits 282 and 284 to connect with the jacks (not shown) actuating doors 220 and 222 to open and close aperture 214.

Figure 8:
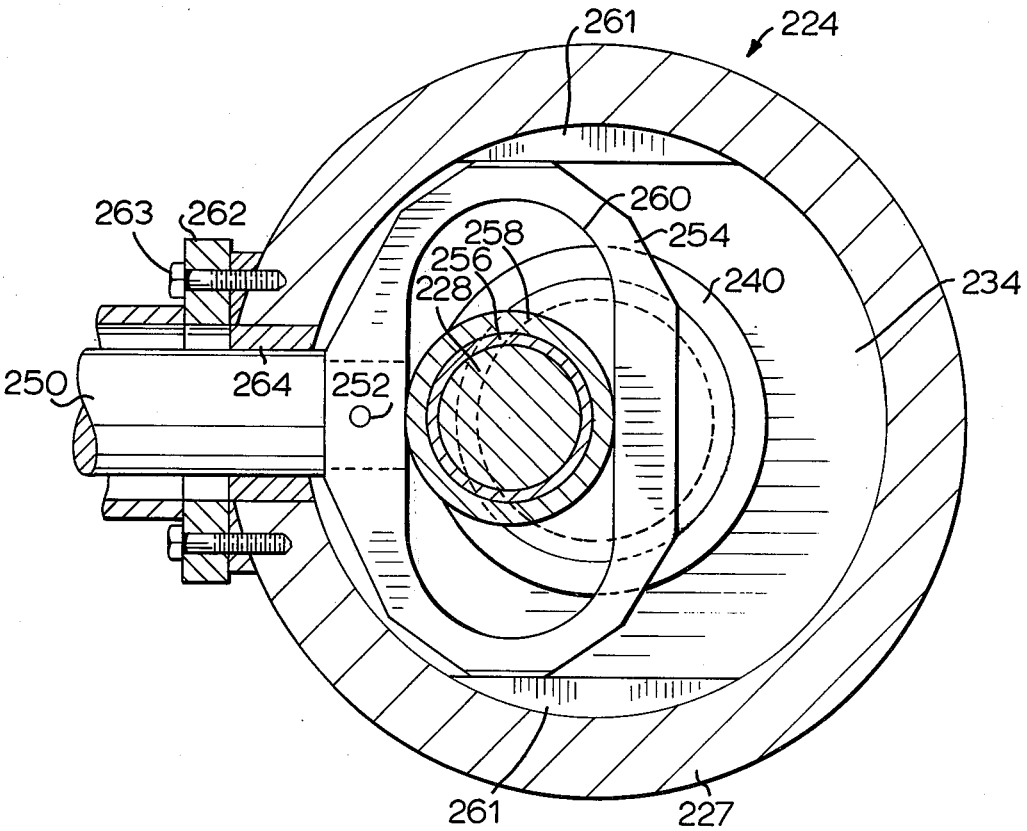
FIG. 8 is a cross-sectional view of the hub portion of the eccentric cutter bar taken along line 8—8 of FIG. 7, the cutter bar being fully extended.
Figure 10:
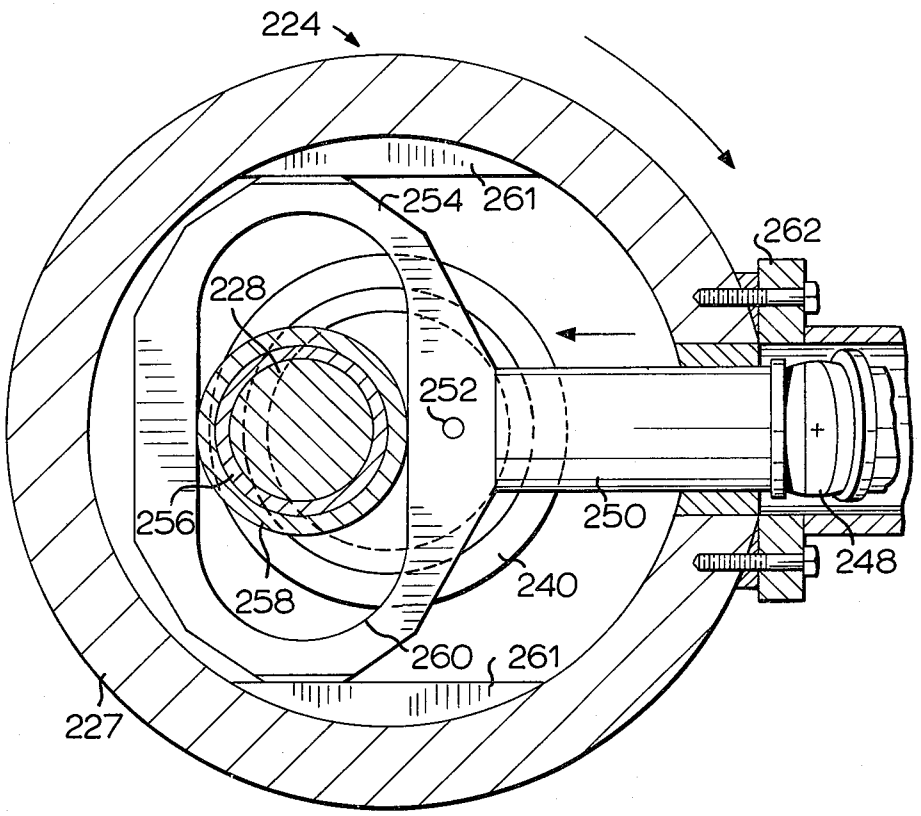
FIG. 10 is a view similar to FIG. 8 showing the eccentric cutter bar rotated 180° about the axis of the cutting head and fully retracted.
Figure 9:
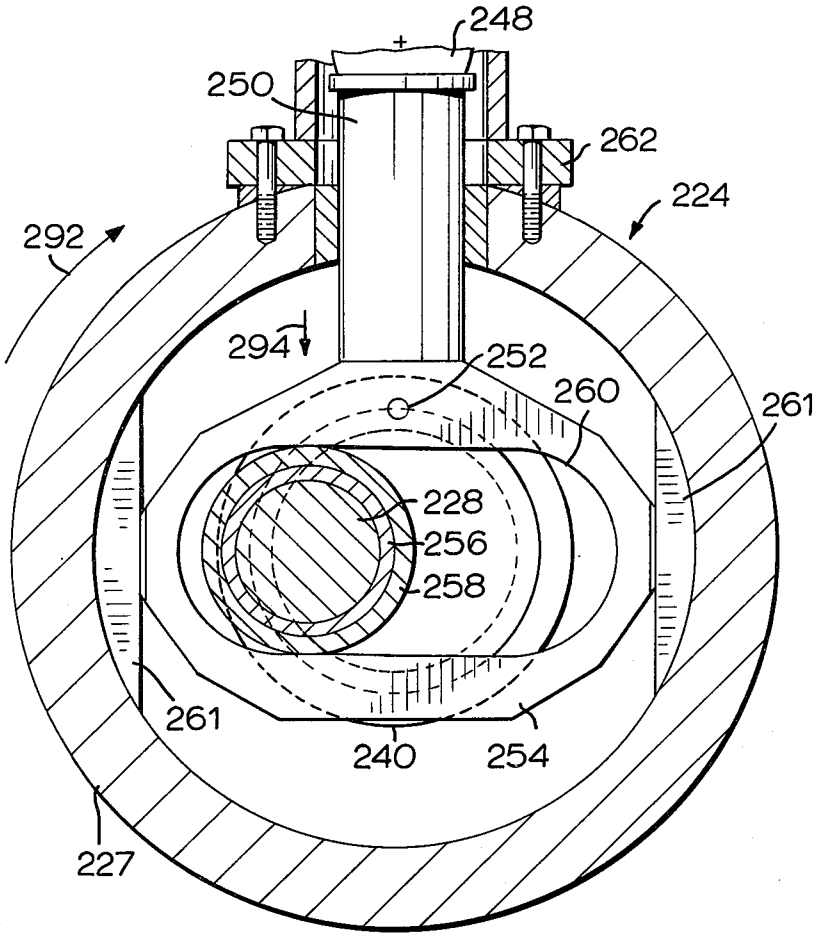
FIG. 9 is a view similar to FIG. 8 showing the eccentric cutter bar rotated 90° about the axis of the cutting head and semi-retracted.

In the operation of the apparatus shown in FIGS. 5 to 11, cutting head 204 is rotated as before. As cutting head 204 rotates, the intersection of eccentric shaft 228 with guide 254 in hub 224 causes the outer end of cutter bar 226 to follow a path 290, as seen in FIG. 11, which is eccentric to the axis of the cutting head. This interaction between eccentric shaft 228 and guide 254 is shown in three positions of cutter bar 226 in FIGS. 8, 9 and 10 of the drawings. In FIG. 8 cutter bar 226 is in its extended position of maximum eccentricity. As cutting head 204 rotates in the direction of arrow 292 of FIG. 9, the fixed position of eccentric shaft 228 causes slide 254 to shift along channels 261, drawing shaft 250 radially inwardly in the direction of arrow 294. Further rotation of cutting head 204 in the same direction causes a further inward shift of shaft 250 until cutter bar 226 is in its retracted position of minimum eccentricity as seen in FIG. 10, 180° from its extended position of FIG. 8. On continued rotation of cutting head 204, cutter bar 226 again moves radially outwardly with prongs 272 following path 290 in FIG. 11. It will be appreciated that universal joints 246 and 248 enable shaft 244 of cutter bar 226 to move inwardly and outwardly through the angle of boss 262 conforming to the surface angle of cutting head 204.

The opening or closing of aperture 214 in face plate 206 of cutting head 204 is controlled as in the previous embodiment by doors 220 and 222. Usually door 220 or 222 is closed behind cutter bar 226 (depending on the direction of rotation of cutting head 204), leaving only that part of aperture 214 open which is in advance of the direction of travel of the cutter bar.

The operation of cutting head 204 allows the tunnelling apparatus to follow a curving path as it excavates. The degree and the direction of curvature is governed by the eccentricity of shaft 228 which may be suitably selected for the required performance.

It will be appreciated that each aperture 56 or 214 may have only a single flood door movable to close or open the aperture although a pair of doors for each aperture is preferable.

I claim:

1. An apparatus for tunnelling through soil, comprising: a cylindrical housing;

a cutting head rotatably mounted on one end of the housing coaxial therewith and closing said one end, the cutting head having an outwardly projecting conical face with at least one aperture therein opening into the housing;

at least one toothed cutter bar mounted radially on the cutting head adjacent the face thereof and in front of the aperture;

at least one flood door mounted on the cutting head and slidable laterally on the conical face thereof to open or close the aperture or to vary the size thereof;

means mounted on the cutting head to move the flood door; and means mounted in the housing to rotate the cutting head to advance the housing, and to convey soil rearwardly from the cutting head.

2. An apparatus as claimed in claim 1 including a conical fan plate rotatably mounted coaxially on the cutting head, the flood door comprising a lobe of the fan plate.

3. An apparatus as claimed in claim 2 in which the means to move the flood door comprises a hydraulic jack, the cutting head having a circumferential side wall, the hydraulic jack being pivotally mounted at one end on the side wall of the cutting head and at the other end on the lobe of the fan plate.

4. An apparatus as claimed in claim 3 in which the hydraulic jack is connected to a source of pressurized fluid in the housing through a slip ring mounted coaxially on the cutting head.

5. An apparatus as claimed in claim 1 in which a pair of flood doors are movable to close the aperture by convergence and to open the aperture by divergence.

6. An apparatus as claimed in claim 5 in which the movement of each of said flood doors is individually controllable.

7. An apparatus as claimed in claim 5 including a pair of contiguous conical fan plates each rotatably mounted coaxially on the cutting head, each flood door comprising a lobe of a different one of said fan plates.

8. An apparatus as claimed in claim 1 in which a plurality of apertures open into the housing and a plurality of flood doors are movable to open or close the apertures or to vary the size thereof, the flood doors comprising the lobes of at least one conical fan plate rotatably mounted coaxially on the cutting head, the means to move the flood doors comprising a plurality of hydraulic jacks one connected with each of said lobes, the cutting head having a circumferential side wall, one end of each hydraulic jack being pivotally mounted on the side wall of the cutting head and the other end being pivotally mounted on the lobe of the fan plate.

9. An apparatus as claimed in claim 8 in which the hydraulic jacks are connected to a source of pressurized fluid in the housing through a slip ring mounted coaxially on the cutting head.

10. An apparatus as claimed in claim 8 in which a pair of flood doors are movable to open or close each of said apertures or to vary the size thereof, one of the doors of said pair comprising a lobe of a first fan plate, the other of said doors comprising a lobe of a second fan plate, said fan plates being contiguous one to the other and being rotatably mounted coaxially on the cutting head.

11. An apparatus as claimed in claim 10 in which the movement of each of said fan plates is individually controllable.

12. An apparatus as claimed in claim 1 in which the cutter bar is movable radially outward beyond the circumference of the cutting head whereby the outer end of the cutter bar describes an arcuate path eccentric to the face of the cutting head.

13. An apparatus as claimed in claim 12 in which the cutter bar is mounted at one end on a shaft fixed on the cylindrical housing and eccentric to the axis of the housing and the cutting head.

14. An apparatus as claimed in claim 13 in which said one end of the shaft of the cutter bar carries a guide coupled thereto by a pair of spaced apart universal joints, the guide bar having a slot transverse to the axis of the cutter bar and accommodating the eccentric shaft slidably therein.

* * * * *